United States Patent [19]

Huggett

[11] 4,453,701

[45] Jun. 12, 1984

[54] SELF-TAILING WINCH

[75] Inventor: Richard D. J. Huggett, Horndean, England

[73] Assignee: Lewmar Marine Ltd., Hampshire, England

[21] Appl. No.: 335,849

[22] Filed: Dec. 30, 1981

[30] Foreign Application Priority Data

Jun. 10, 1981 [GB] United Kingdom ..... 8117819

[51] Int. Cl.[3] ..... B66D 1/30; B66D 1/78

[52] U.S. Cl. ..... 254/371; 474/19

[58] Field of Search ..... 254/371, 344, 391; 226/190; 474/19; 242/118.5

[56] References Cited

U.S. PATENT DOCUMENTS

| | | | |
|---|---|---|---|
| 2,711,103 | 6/1955 | Miener | 474/19 |
| 3,118,312 | 1/1964 | Getz et al. . | |
| 3,985,340 | 10/1976 | Guangorena | 254/371 |
| 4,151,980 | 5/1979 | Burton et al. | 254/371 |
| 4,274,295 | 6/1981 | Grube | 474/19 |

*Primary Examiner*—Billy S. Taylor

*Attorney, Agent, or Firm*—Cushman, Darby & Cushman

[57] ABSTRACT

The channel of a self-tailing winch is made up of two jaw members (5,17) interlinked by an arrangement such that when there is relative rotation between the jaws a relative axial displacement is imposed upon them by that relative rotation. Cam following studs (20) associated with one jaw engage in inclined camming slots (22) associated with the other. The inclination of the slots is preferably "positive" i.e. such as to cause closer axial approach of the jaws when there is any slippage.

6 Claims, 5 Drawing Figures

SELF-TAILING WINCH

FIELD OF THE INVENTION

This invention relates to self-tailing winches.

BACKGROUND OF THE INVENTION

Self-tailing winches are by now well known as a general type. In addition to the winch drum which exerts the main hauling effort, there is a channel adjacent to one end of the drum which has the function of gripping the free run of line while a coil of line is consolidated upon the drum. The yachtsman may more or less casually apply a few turns of line around the drum and place the free end in the self-tailing channel. As the winch is rotated the line is gripped in the channel and the coil is consolidated.

It is desirable that the self-tailing channel should exert a fairly firm traction on the line without however holding it so tight that it is difficult to strip or to remove from the channel, and at the same time it is desirable to allow for the fact that lines of different diameters may be used on the winch and should at least within a given range of diameters be capable of use in the self-tailing channel.

One successful solution of the first problem and a partial solution of the second problem has been seen in U.S. Pat. No. 4,151,980, which shows how an effective grip may be obtained by effectively bending the line past staggered teeth on opposite sides of the jaws which form the channel. This arrangement is also to a certain extent self-compensating in accordance with the tension experienced by the line and the diameter of the line. However, it does not completely solve the problem of adjusting to various diameters of line.

There have been proposals in U.S. Pat. Nos. 3,968,953 and 3,985,340 and U.K. Pat. No. 1,558,784 for self-tailing channels in which one jaw is moveable relative to the other so as to accommodate lines of different diameters. However, this motion towards or away from the other jaw has in all these proposals been a straight line axial motion and has been resisted by axially directed springs which are responsive only to line size, not to the tension experienced by the line, since the channels were designed so that the line would contact the radially innermost base of the channels.

We have also proposed in U.K. Pat. No. 1,550,175 a self-tailing channel in which one jaw is in the absence of line free to rotate unlimitedly relative to the other jaw. The purpose was to allow in at least one drive ratio of the winch that the drum would in effect be driven from that jaw which is remote from it. No relative axial motion was constrained onto the jaws.

SUMMARY OF THE INVENTION

In the present invention the jaws making up a self-tailing channel of a winch are displaceable one relative to the other in a helical direction.

The directionality of the relative movement is imposed upon the jaws by a camming arrangement whereby any tendency of one jaw to move tangentially (rotationally) relative to the other is converted by the camming arrangement into a tendency to move also in the axial direction; thus, drag by a line positioned between the jaws and tending to slip relative to one of them will cause a relative displacement of the jaws in such a sense as to cause axial closing together of the jaws and hence an increased grip on the line. This effect will be available within a range of diameters of line any one of which may be used between the jaws, the starting point of the jaws along the camming arrangement being immaterial to the action resulting from any tendency of the line to slip between the jaws.

The coming arrangement is preferably provided by at least one helical channel interacting with at least one stud, one of the channel and the stud being on the jaw and the other of them on a ring constrained to rotate with the drive of the self-tailing channel as a whole. The angle of the helical channel (that is to say whether it tends to move the jaws axially together upon relative anti-clockwise rotation) will depend upon which of the jaws is arranged for the primary driving and holding effect on the line in the channel.

In a preferred embodiment one jaw is constrained to rotate at all times with the main drum of the winch and the other jaw is able to rotate relative to that, over a limited angle of rotation. Rotation of the drum is always clockwise and the moveable jaw tends to rotate in an anti-clockwise relative direction if there is any slip of the line placed between the two jaws. In a preferred arrangement this slip inter-acts with an appropriately inclined camming arrangement on a ring also constrained to rotate at all times with the drum so as to cause by virtue of the slip a degree of relative approach together of the two jaws.

As is disclosed in our U.S. Pat. No. 4,151,980 with particular reference to FIG. 13 thereof the base of the self-tailing channel may be a stationary member which provides at one point in its circumference a stripper tongue which entrapped within and may radially support a line guide member projecting from the top of the winch, over the upper jaw.

When the base of the channel is stationary and since it is not desired that the line shall come in contact with it during normal working, that base is of a smaller diameter than the working diameter of the drum. This relationship may be preserved even if the base of the channel rotates.

DESCRIPTION OF DRAWINGS AND OF A PREFERRED EMBODIMENT

Embodiments of the present invention are now described by way of example with reference to the accompanying drawings wherein.

Figure 1:
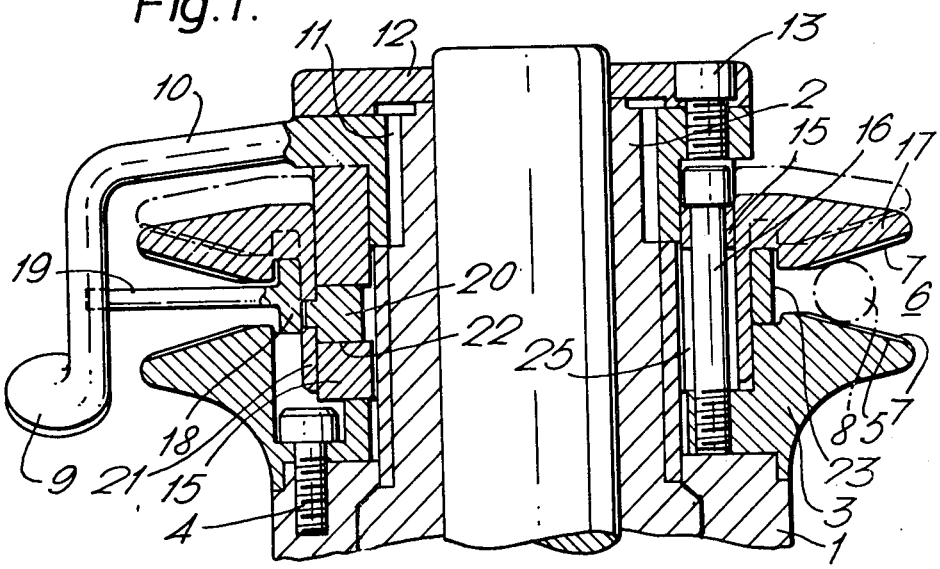
FIG. 1 is a diametrical section through a first embodiment.

In FIG. 1, a winch drum 1 is conventionally mounted for rotation about a hollow cylindrical stationary post 2 and driven relative to that post in the conventional clockwise direction by manual power through conventional drive means either in a one-to-one relationship or through gearing. The principle of the present self-tailing winch is applicable to either single speed of multi-speed winches.

At the upper end of the drum a flange member 3 is secured by bolts 4 so as to be at all times constrained to rotate with the drum. This member 3 offers one jaw 5 of a self-tailing channel 6 arranged to be coaxial with and adjacent one end of the drum. The jaw 5 has radial or slewed straight or curved rib-like teeth 7 which offer a contact surface with a line such as the line shown in dotted lines at 8 in FIG. 1, which is placed in the channel after having been passed a few times around the drum 1. This placing is guided by a line guide channel 9 which depends from an arm 10 which is splined at 11 to the top of the cylindrical column 2 and which is held in position by a top plate 12 assembled by means of bolts 13. Before such assembly, however, a cam-ring 15 and upper jaw member 17, together with a channel base ring 18 are assembled to the flange member 3 by bolts 16 passing through the cam-ring 15.

Figure 3:
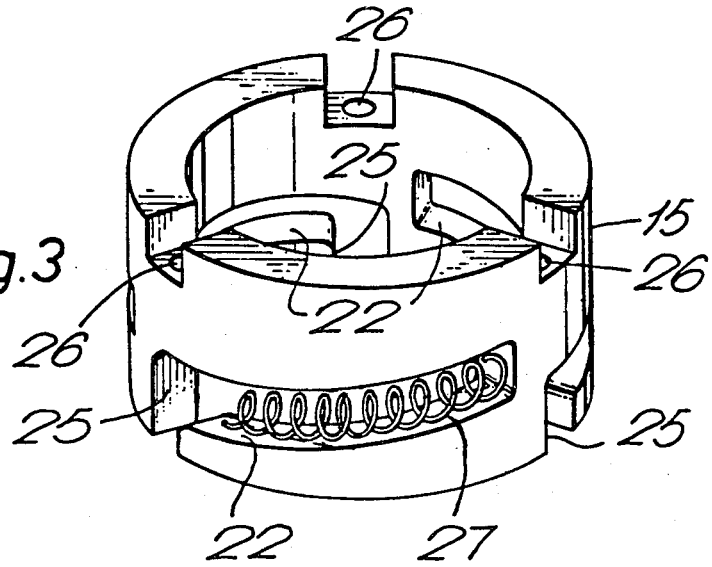
FIG. 3 is a perspective view of a camming ring of the first embodiment.

The upper jaw member 17 and cam-ring inter-engage by means of studs 20 projecting inwardly from the inner periphery of a sleeve part 21 of the upper jaw member 17 and which project into and are slidable along helical camming slots 22 in the cam-ring 15. As will be explained the angle at which the slots 22 are inclined may be "positive" or "negative" and two possibilities are shown in full and dotted lines in FIG. 3.

The base-ring 18 has at one part of its periphery a projecting lug 19 which when seen in plan view is generally triangular in shape and which fits between side walls of the channel cross-section of the depending part of the arm 10, as is disclosed in U.S. Pat. No. 4,151,980. Thus the ring 18 is retained stationary though both of the jaw members 5 and 17 rotate. Since it is stationary its outermost periphery 23 has a diameter less than that of the drum 1 since the preferred working diameter adopted by the line in the self-tailing channel will be substantially the same as that of the drum 1, and it is not particularly desirable that the line should touch this stationary base.

It can be seen that if the jaw member 17 tends to execute relative rotational movement relative to the ring 15, it will be constrained by the camming action of the inclined walls of the slots 22 to execute a helical motion, that is to say a motion which has both a rotational and an axial component.

Figure 4:
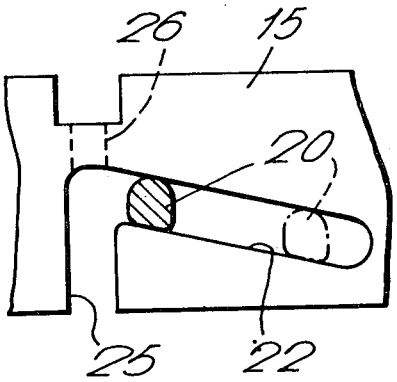
FIG. 4 is a developed and diagrammatic view of the positioning of a cam follower in the cam groove of the ring.

The developed view in FIG. 4, showing in dotted and full lines two positions of the stud 20 along such a slot, illustrates this as also do the full and dotted line positions of member 17 in FIG. 1.

The jaw 17 is provided also with teeth 7, but the primary tendency for driving or pulling the line will derive from the lower jaw 5. If the line tends to slip relative to that lower jaw it will tend to retard the upper jaw 17 through inter-action with the teeth of that jaw and there will tend to be relative rotation between that jaw and the cam-ring 15. If the relative rotation is anti-clockwise and the dotted line inclination of slots 22 seen in FIG. 3 and seen in full lines in FIG. 4 will tend to cause a mutual relative approach of the two jaws and consequently an increased grip upon the line. Immediately relative slippage ceases no tighter grip is exerted on the line. Furthermore, if it is wished to release the line by hand the tendency is to pull on the free end which will give—with the "positive" inclination seen in FIG. 4—a tendency for the two jaws to be separated axially.

The actual assembly of the channel is, after the positioning of the flange member 7, first the positioning of the ring 18 then the assembly together of the jaw member 17 and cam-ring 15 by the introduction of the studs 20 through the axially directed channels 25 which lead to the slots 22 and then the screwing down of the thus assembled ring and jaw member by the bolts 16 which pass through bores 26 which are aligned with the channels 25 so that the bolts block off those channels and prevent any escape of the stud 20. Thereafter the arm member 10 is fitted and the top plate 12.

In an alternative but less preferred manner of working the inclination of the slots 20 is negative in the sense that anti-clockwise slip of the moveable jaw will tend to increase the axial distance between the jaws. However, this tendency is overridden by a strong compression spring 27 housed in such a slot 22 and tending to urge a stud 20 towards the open-end of the slot 22 that is to say towards the condition in which the jaws are at closest approach.

Figure 2:
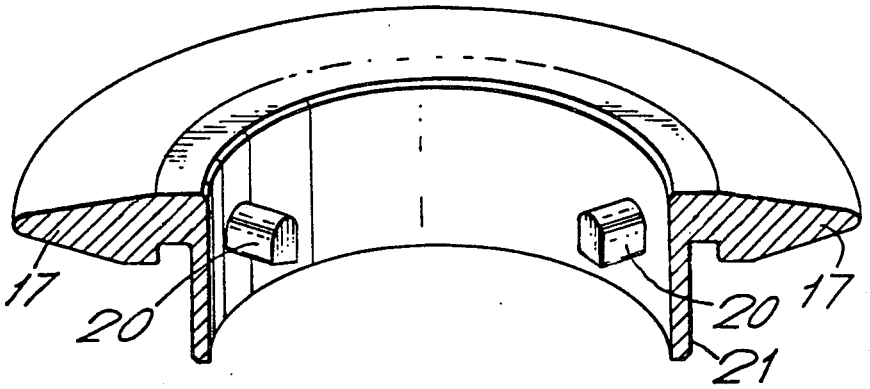
FIG. 2 is a diametrical section and perspective view of the moveable jaw of the first embodiment.

As indicated in FIG. 2 the jaw member 17 may be monolithic with the studs 20 fitted through its skirt 21, or may be manufactured in two parts, with a flanged sleeve secured to an annular jaw member 17.

Figure 5:
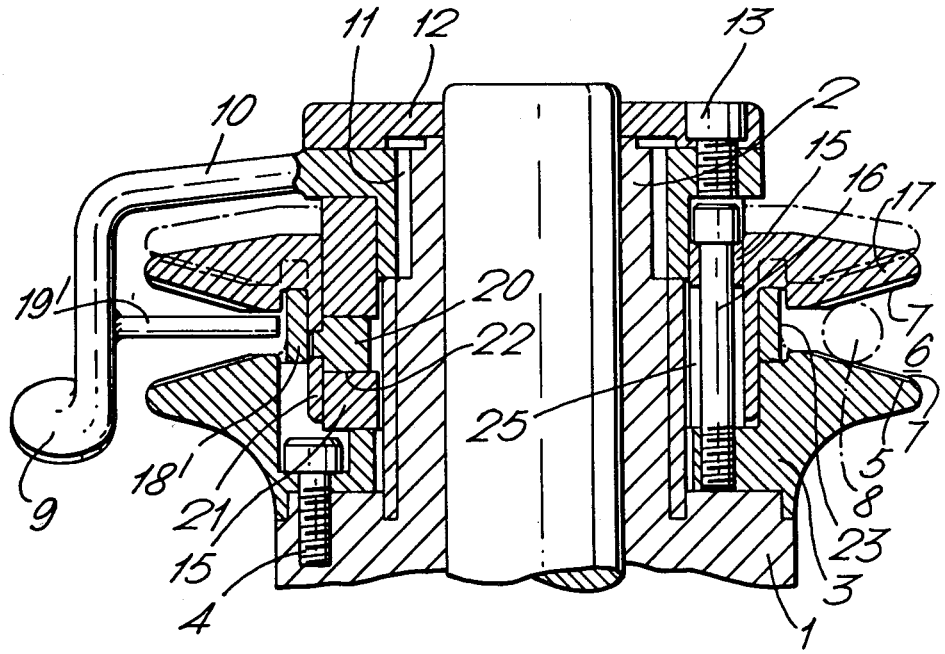
FIG. 5 is a diametrical section through a modification.

FIG. 5 shows a modification which is generally similar to the first embodiment except that the lug 19' forming the stripper tongue is connected to the arm 10 and not to the channel base ring 18'. The ring 18' may then be freely rotatable in the channel 6. In an alternative arrangement (shown dotted in FIG. 5) the ring 18' is formed integrally with the flange member 3. Both of these arrangements enable friction to be reduced when "through-tailing". For this reason these are at present the preferred forms, especially that where the channel base is integral with the jaw. When the line is first passed around the drum and channel, it is usual to tighten the line onto the drum, before winching is commenced, by pulling on the free end of the line. This is known as through-tailing. The drum of the winch tends to rotate with the line and, if the base of the channel is fixed as in FIG. 1, then because the upper jaw is axially movable there may be contact between the base and the line which can cause unacceptable friction if the base is stationary. An additional reduction in friction can be achieved by providing rollers on the line guide.

I claim:

1. A self-tailing winch comprising a winch drum, means mounting the drum for rotation about an axis, a self-tailing channel adjacent the drum, two jaw members defining the self-tailing channel, means constraining one said jaw member permanently to rotate with the drum, means mounting the other jaw member for limited rotational and axial displacement relative to the said one jaw member, the said jaw mounting means comprising means for imposing a helical relationship on said rotational and axial displacements.

2. A self-tailing winch according to claim 1 wherein the jaw mounting means comprise cam means.

3. A self-tailing winch according to claim 2 wherein said jaws are unbiased against rotational displacement in either direction.

4. A self-tailing winch according to claim 1 wherein the said one jaw member is adjacent to and fast with the winch drum; the said other jaw member is a descrete member remote from the drum, and a radially innermost base of the channel is defined by a rotationally fixed member.

5. A self-tailing winch according to claim 1 wherein a radially innermost base of the channel is defined by a member extending around said channel and freely rotatable therein.

6. A self-tailing winch according to claim 1, wherein a radially innermost base of the channel is defined by an annular member fast with said one jaw member.

* * * * *